United States Patent [19]

Hettinger, Jr.

[11] Patent Number: 4,551,234

[45] Date of Patent: Nov. 5, 1985

[54] RECLAIMING LUBE OIL IN MRS UNIT

[75] Inventor: William P. Hettinger, Jr., Russell, Ky.

[73] Assignee: Ashland Oil, Inc., Ashland, Ky.

[21] Appl. No.: 637,378

[22] Filed: Aug. 3, 1984

[51] Int. Cl.[4] ..... C10M 11/00; C10G 25/00; C10G 25/09; C10G 71/00

[52] U.S. Cl. ..... 208/179; 208/182; 208/251 R; 208/253; 208/78

[58] Field of Search ..... 208/179, 182, 253, 251 R, 208/78

[56] References Cited

U.S. PATENT DOCUMENTS

| | | | |
|---|---|---|---|
| 2,446,489 | 8/1948 | Schaafsma | 208/179 |
| 3,980,551 | 9/1976 | Wolk | 208/179 |
| 3,983,030 | 9/1976 | Rosynek et al. | 208/253 |
| 4,116,814 | 9/1978 | Zahner | 208/78 |
| 4,412,914 | 11/1983 | Hettinger et al. | 208/253 |
| 4,427,539 | 1/1984 | Busch et al. | 208/253 |

FOREIGN PATENT DOCUMENTS

| | | | |
|---|---|---|---|
| 462634 | 1/1950 | Canada | 208/182 |

*Primary Examiner*—D. E. Gantz
*Assistant Examiner*—Helane Myers
*Attorney, Agent, or Firm*—Richard C. Willson, Jr.

[57] ABSTRACT

Regenerated sorbent employed for refining of heavy crude feedstocks is used to remove contaminants from specialized hydrocarbons, especially used motor oil. The simultaneous operation of a decontaminating unit supplied with regenerated sorbent particulate from the regenerator of a heavy hydrocarbon refining system is utilized.

3 Claims, 1 Drawing Figure

MRS UNIT - CONTACTOR / DECONTAMINATOR SYSTEM

RECLAIMING LUBE OIL IN MRS UNIT

CROSS REFERENCE TO OTHER APPLICATIONS

U.S. Ser. No. 355,661, filed Mar. 12, 1982 also PCT No. 81/00648, filed May 25, 1982 relates to the field of this application.

BACKGROUND OF THE INVENTION (1) Field of Invention

The invention relates to the removal of undesirable materials and ash from used or otherwise contaminated motor oil. The invention also relates to avoidance of environmental problems associated with disposal of heavy metal salts, and other persistent pollutants contained in used motor oil, by dumping the oil into the aquifers of landfills, sludge ponds, or storage drums, which are, themselves, capable of deterioration. (U.S. Patent class/subclass: 208/179, /180, /181, /182, /183, /184, /251, /289 and /283).

(2) Utility of the Invention

Improvement of used motor oil by removal of degraded components and other contaminants can provide reclaimed and reusable motor oil, which is often formulated with some added amounts of detergent-inhibitor package or else blended as an inexpensive added basestock with new motor oil. Used motor oils, both with and without partial removal of contaminants and ash have been used as rust inhibitors for equipment and machinery, as well as added components for hydrocarbon fuels.

(3) Description of Prior Work

Reclaiming of used motor oil may be distinguished from re-refining in that no high temperature distillation of motor oil basestocks is involved. The process thus is usually less expensive than re-refining. In spite of the value of recovering lubricant basestocks, reclamation has been minimal because of attendant expense involved in collection of small amounts of oil drainings and their shipment to a central point. However, recent awareness of the public, to the threat of water pollution, by used motor oil has generated new incentives for reclamation.

Reclaiming motor oil normally involves treatment with a solvent containing an active purifying agent. Although motor oil of a purer nature is obtained, usually an appreciable amount of sludge is coproduced as the contaminated solvent by-product. This sludge must then be disposed of in some non-polluting fashion. Sometimes it is concentrated by relatively expensive flash distillation.

In U.S. Pat. No. 4,105,538, for example, Mattox adds a light paraffinic hydrocarbon fraction, along with a rather expensive amine. Subsequently, appreciable portions of heavy metal salts and other contaminants precipitate to the bottom as solids. Excess light paraffinic fraction and amine must then be removed, although, with some amines, if attention is paid to the motor oil application later used, some amine can practicably be left in the reclaimed product.

In U.S. Pat. No. 3,879,282, Johnson employs water containing phosphate salts, in a sealed autoclave at about 170 psig and 132° C. (270° F.). Substantial amounts of contaminants and ash precipitate in the water phase as insoluble metal phosphates. Johnson's preferred embodiment involves a specially constructed multistep facility employing preheaters, vigorously agitated pressure vessels, a phase separator, settlement tank, and filters. Gasoline and water remaining in the oil are removed by a flash distillation step. Recycled water is then purified sufficiently for recycle or else rigorously enough to be discarded into the environment. Filtration of the treated oil is carried out with silica gel in order to remove extraneous matter, especially tetraethyl-lead which is not removed by the prior treatment.

Petroleum refiners have been investigating means for processing reduced crudes, such as by visbreaking, solvent deasphalting, hydrotreating, hydrocracking, coking, Houdresid fixed bed cracking, H-oil, and fluid catalytic cracking. One or more approaches to the processing of reduced crude to form transportation and heating fuels is that described in copending applications, U.S. Ser. No. 904,216 (now U.S. Pat. No. 4,341,624); 904,217 (now U.S. Pat. No. 4,347,122); 094,091 (now U.S. Pat. No. 4,299,687); 094,277 (now U.S. Pat. No. 4,354,923) and 094,092 (now U.S. Pat. No. 4,332,673) which are herein incorporated by reference thereto.

In the operations of the above identified applications, a reduced crude is contacted with a hot regenerated catalyst in a short contact time riser cracking zone, the catalyst and products are separated instaneously by means of a vented riser to take advantage of the difference between the momentum of gases and catalyst particles. The catalyst is stripped, sent to a regenerator zone and the regenerated catalyst is recycled back to the riser to repeat the cycle. Due to the high Conradson carbon vlues of the feed, coke deposition on the catalyst is high and can be as high as 12 wt % based on feed. This high coke level can lead to excessive temperatures in the regenerator, at times in excess of 1400° F. to as high as 1500° F. which can lead to rapid deactivation of the catalyst through hydrothermal degradation of the active cracking component of the FCC catalyst (crystalline alumiosilicate zeolites) and unit metallurgical failure.

SUMMARY

The present invention can employ existing petroleum refinery facilities which have been slightly modified for co-production of reclaimed motor oil. Especially useful for this purpose is a refining unit known as an carbon and metal removal system (MRS) such as that described by Bartholic in U.S. Pat. No. 4,325,817 and U.S. Pat. No. 4,263,128. Related technology is also discussed in U.S. Ser. No. 355,661, filed Mar. 3, 1982.

A preferred embodiment of the invention involves pumping spent lubricating oil to a small riser mounted along side a large MRS unit under conditions which cause oil boiling in the range of 316° C. to 510° C. (600° F. to 950° F.) to be gently vaporized and lifted from the lubrication oil contaminants and ash and recovered for recycle to a lubrication oil processing plant. The ash and sludge laden sorbent from the MRS treatment unit are disposed of or regenerated in much the same way as is the same sorbent when it has been spent (contaminated) in the process of use in an ordinary refining unit.

DESCRIPTION OF PREFERRED EMBODIMENT

Figure 1:
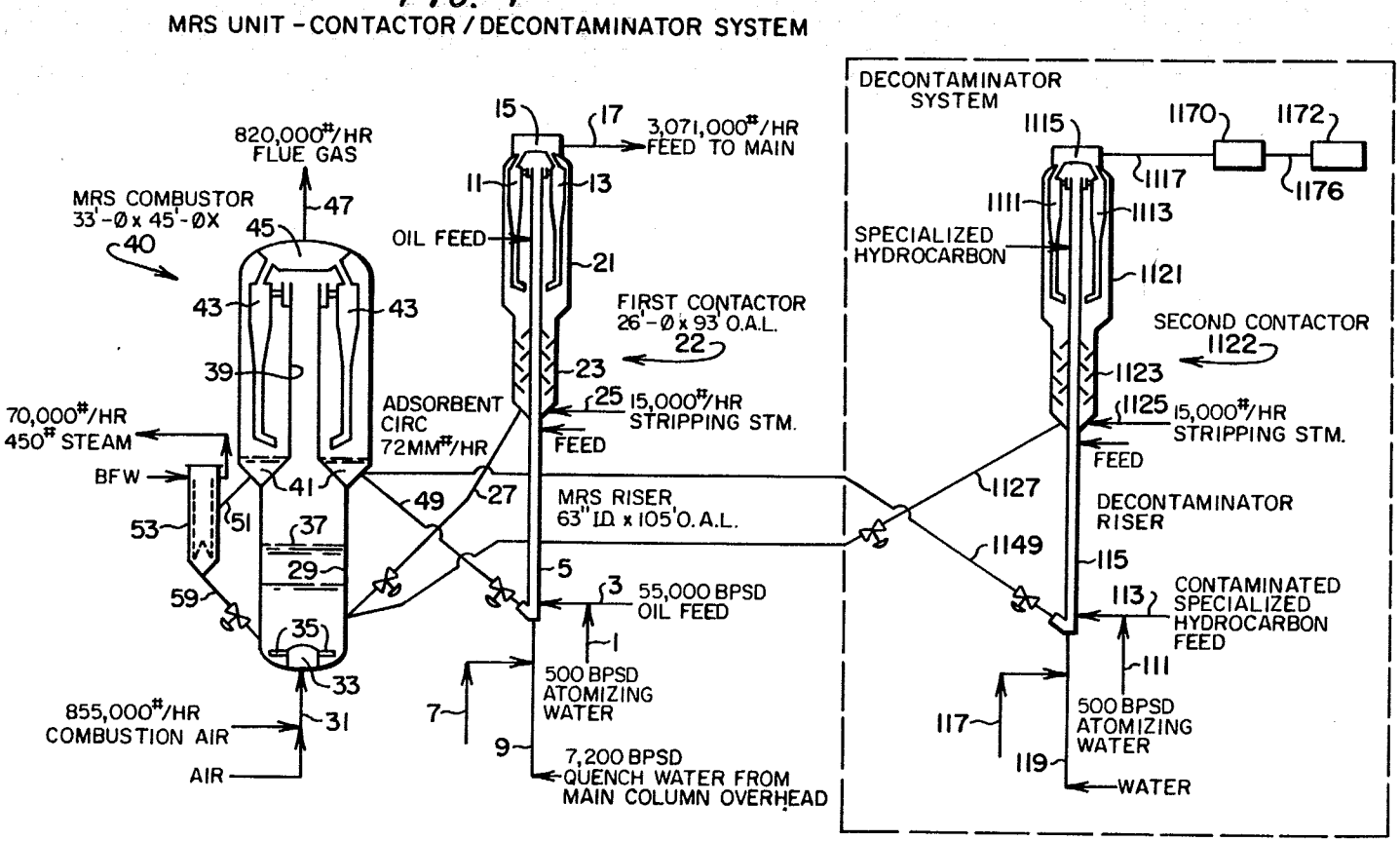
FIG. 1 is a schematic diagram of preferred apparatus for practicing the invention.

The apparatus of this invention can comprise a combustor, a first contactor, second contactor, a cooling means, and a receiving vessel. The inlets and outlets for each of the above listed pieces of equipment are as follows:

The combustor has at least two inlets which will be hereinafter referred to as the regeneration gas inlet and the spent catalyst-inlet and has at least two outlets which are hereinafter referred to as the regeneration gas outlet and the active catalyst-outlet. The first contactor has at least four inlets which will hereinafter be referred to as the first contactor more active catalyst inlet, the first contactor quench-inlet, the first contactor feed-inlet, and the first contactor stripping steam-inlet, and has at least two outlets which are hereinafter referred to as the first contactor spent catalyst-outlet and the first contactor product-outlet. The second contactor has at least four inlets which will hereinafter be referred to as the second contactor active catalyst-inlet, the second contactor quench-inlet, the second contactor feed-inlet, and the second contactor stripping steam-inlet, and has at least two outlets which are hereinafter referred to as the second contactor spent catalyst-outlet and the second contactor product-outlet.

The above described apparatus with its corresponding inlets and outlets is connected together in the following way: The regeneration gas inlet is adapted to be connected to a source of oxidizing gas. The spent catalyst-inlet is connected to the first contactor spent catalyst-outlet and also the second contactor spent catalyst-outlet so that solid, spent catalyst can be communicated to the combustor for regeneration. The active catalyst-outlet is connected to the first contactor active catalyst-inlet and also the second contactor active catalyst-inlet so that solid, active catalyst can be communicated to the first and/or second contactors for contact with feed or feeds. The regeneration gas-outlet is adapted to be connected to a means for enrichment with oxidizing gas prior to further recycling. The first contactor active catalyst-inlet is connected to the combustor as heretofore described. The first contactor quench-inlet is adapted to be connected to a source of atomizing material such as water and steam. The first contactor feed inlet is adapted to be connected to a source of heavy hydrocarbon feed such as residuum. The first contactor stripping steam-inlet is adapted to be connected to a source of stripping gas such as steam. The first contactor product outlet is adapted to be connected to a receiving vessel and preferably proceeding beforehand through a means for recycle.

The second contactor active catalyst-inlet is connected to the combustor as heretofore described, the second contactor quench inlet is adapted to be connected to a source of atomizing material such as water and steam. The second contactor feed-inlet is adapted to be connected to a source of contaminated specialized hydrocarbon feed such as used motor oil. The second contactor stripping steam-inlet is adapted to be connected to a source of stripping gas such as steam. The second contactor product-outlet is adapted to be connected to a receiving vessel and preferably proceeding beforehand through a cooling means. It will be understood by those skilled in the art that the invention is not to be limited by the above example and discussion, and that the example is susceptible to a wide number of modifications and variations departing from the invention. For example, all contactors need not be simultaneously in use. The active and spent catalyst conduits may proceed from and to the combustor independently or in manifold fashion. There may be multiple second contactors in parallel connection, with respect the first contactor, to the combustor. These multiple contactors might be connected in series, feed to product which would in turn become partially refined second or third feeds, rather than operating the contactors independently with regard to the feed to final product step.

An oil feedstock such as residuum having an initial boiling point of 350° C. or higher is introduced via conduit 3 into a first contactor 22 wherein the feedstock is contacted more active solid sorbent particulate material having little, if any, cracking activity under conditions employed, which are those needed to thermally visbreak and reduce metal contaminants to a more acceptable lower level in conjunction with reducing the feed Conradson carbon value. The first contactor 22 comprises a riser reactor 5, hereinafter called the first riser, for selectively thermally contacting the oil feed comprising metal contaminants with the active solid sorbent particulate material of little or no catalytic cracking activity to accomplish substantial metals removal in the absence of excessive thermal cracking of the oil feed. Atomizing water is added by conduit 1 to the feed introduced by conduit 3 to the first riser 5 above the bottom portion thereof. Steam in conduit 7, and/or admixed with water in conduit 9, is admixed with circulated hot solid particulate in the bottom portion of the first riser in amounts and under conditions selected to adjust the temperature of the hot solids obtained from the regeneration thereof and before contacting the oil feed particularly selected for charge to the first riser 5. If desired, a "wet gas" (e.g. light hydrocarbons) or other lift gas can be employed to convey the particulate throught the first riser 5. The suspension passed through first riser 5 is discharged from the top or open end of the riser and separated so that vaporous hydrocarbons of thermal visbreaking material and gasiform diluent material are caused to flow through a plurality of parallel arranged cyclone separators 11 and 13 positioned about the upper open end of the riser contact zone. Hydrocarbon vapors separated from entrained solids by the cyclone separators 11 and 13 are collected in a plenium chamber 15 before withdrawal and recovery by conduit 17. Solid particulate material comprising spent sorbent particles containing accumulated metal deposits and carbonaceous material of thermal degradation are collected in a bottom portion of vessel 21 comprising a stripping section 23 to which a stripping gas is charged by conduit 25. Stripped solid absorbent particulate is passed by standpipe 27 provided with a flow central valve 28 to fluid bed of particulate in a bottom portion of regeneration zone 29. In like manner to that through standpipe 27, stripped solid particulate from the second contactor is passed by standpipe 1127 to a fluid bed of particulate in a bottom portion of regeneration zone 29 of the combustor 40 from the second contactor 1122.

Regeneration gas or combustion supporting gas such as oxygen modified gas or air is charged to a bottom portion of the regeneration zone by conduit 31 through a plenuim distribution chamber 33 supporting a plurality of radiating gas distributor pipes 35. Regeneration of the spent sorbent particulate to its active form is accomplished by burning deposited carbonaceous material, on and in the spent sorbent, in an oxygen containing gas to CO or $CO_2$ and/or other combustion products. Combustion product gases and catalyst pass from upper level 37 of a fluid bed of particulate in flue gases to an upper enlarged portion of the regeneration vessel where a separation is made between solid particulate and product flue gases by the combination of hindered settling and cyclone separator means. The separate particulate is collected as a fluid bed of material 41 in an annular zone about restricted passageway 39. Flue gas separated from solids pass through a plurality of cyclones 43 positioned about the open upper end of passageway 39 for removal of entrained fines. The flue gases then pass to plenium chamber 45 for withdrawal by conduit 47. Regenerated, that is, active, solid sorbent particulate is passed by standpipe 49 to the bottom portion of first riser 5 for use herein proposed.

In like manner to that through standpipe 49 active solid sorbent particulate is passed by standpipe 1149 to the second contactor 1122. A portion of the hot, active sorbent is withdrawn by conduit 51 for passage to a heat exchanger 53 wherein 450 lb. steam is particularly generated by indirect heat exchange with charged boiler feed water introduced by conduit 55 and steam recovered by conduit 57. The thus partially cooled solid particulate is withdrawn by conduit 59 for passage to a bottom portion of the fluid bed of particulate in a bottom portion of the regeneration zone 29 for temperature control of the metals contaminated particulate being regenerated.

The decontaminator system comprises a second contactor 1122 which is connected by conduits 1127 and 1149 to the combustor 40 in like manner to that of the first contactor 22. A contaminated specialized hydrocarbon feedstock, such as used motor oil, having an initial boiling point of 100° C. or higher is introduced via conduit 113 into a second contactor 1122 wherein the contaminated specialized hydrocarbon is contacted with active solid sorbent particulate material having little, if any, cracking activity under conditions employed, which are those needed to substantially decontaminate the contaminated specialized hydrocarbon by reducing metal and other contaminants which boil higher than the initial boiling point of the contaminated specialized hydrocarbon. The second contactor 1122 comprises a riser reactor 115, hereinafter called the second riser, for selectively thermally contacting the contaminated specialized hydrocarbon feed comprising metal containing and other higher boiling contaminants with the active solid sorbent particulate material of little or no cracking activity to accomplish substantial contaminants removal in the absence of excessive thermal cracking of the specialized hydrocarbon. Atomizing water is added by conduit 111 to the contaminated specialized hydrocarbon feed introduced by conduit 113 to the second riser 115 above the bottom portion thereof. Steam in conduit 117 and/or admixed with water in conduit 119 is admixed with circulated hot solid particulate at a temperature in the range of 350° C. to 500° C. in the bottom portion of the second riser in amounts and under conditions to adjust the temperature of the hot solids obtained from the regeneration thereof and before contacting the contaminated specialized hydrocarbon feed particularly selected for charge to the second riser. If desired, "wet gas" (e.g. light hydrocarbons) or other lift gases can be employed to convey the particulate through the second riser 115. The particular combination of diluents admixed with solids permits establishing a vertical velocity component to the solids before contact with dispersed contaminated specialized hydrocarbon feed material in the riser under selected temperature and pressure conditions. A suspension of solid sorbent particulate and atomized contaminated specialized hydrocarbon feed of low partial pressure in the steam diluent at a temperature below about 500° C. is recovered from riser 115 at a velocity providing a hydrocarbon residence time of less than 3 seconds and preferably within a range of 1 to 28 seconds. The second riser 115 is provided with a plurality of vertically spaced apart feed inlet means to accomplish the above change in hydrocarbon residence time. The ratio of active sorbent to contaminated specialized hydrocarbon feed is preferably within a range of about 3 to 12. The suspension passed through riser 115 is discharged from the top or open end of the riser and separated so that vaporous hydrocarbons and gasiform diluent material are caused to flow through a plurality of parallel arranged cyclone separators 1111 and 1113 positioned about the upper open end of the riser contact zone. Atomized hydrocarbons and/or hydrocarbon vapors separated from entrained solids by the cyclone separators are collected in a plenium chamber 1115 before withdrawal or recovery by conduit 1117 at a temperature at or below about 480° C. The entrained hydrocarbon is communicated to receiving vessel 1172, by passing through conduit 1176 and cooling means 1170 if desired. Solid particulate spent sorbent comprising accumulated metal deposits and carbonaceous material are collected at the bottom portion of vessel 1121 comprising a stripping section 1123 to which stripping gas is charged by conduit 1125 at a temperature of at least about 200° C. Higher stripping temperatures up to 580° C. are also comtemplated. Stripped solid absorbent particulate material is passed by standpipe 1127 provided with a flow control valve to fluid bed of particulate in a bottom portion of regeneration zone 1128 in like manner to that of the standpipe 27 communicating from the first riser 5. Regenerated, that is, active, sorbent is passed from standpipe 1149 to the second riser 115, for use herein proposed, in like manner to that through standpipe 49 to the first riser 5.

It will be understood by those skilled in the art that the invention is not to be limited by the above examples and discussions and that the examples are susceptible to a wide number of modifications and variations without departing from the invention. For example, the single catalyst combusting contactor could supply several specialized hydrocarbon decontaminator combustors attached in parallel to it. Also, several decontaminators could be attached in series so as to partially decontaminate the specialized hydrocarbon in several steps. If desired, the solid sorbent material having very little catalytic activity could be diluted with other types of particulates which would interact with the specialized hydrocarbon or with essentially inert material. Many other variations are possible both in hardward design and process operation.

What is claimed is:

1. A process for disposing of contaminated used lube oil by converting it to useful product, comprising:

(a) contacting a particulate sorbent of low catalytic capability with a carbo-metallic oil feed containing 340° C.+(650° F.+), essentially free of used lube oil in a first contactor to form purified products and contaminated sorbent formed from contact with said carbo-metallic oil feed;

(b) separating said purified products from said contaminated sorbent formed from contact with said carbo-metallic oil feed;

(c) regenerating said contaminated sorbent formed from contact with said carbo-metallic oil feed by heating said contaminated sorbent formed from contact with said carbo-metallic oil feed from about 533° C. to about 683° C. in the presence of oxygen-containing gases;

(d) withdrawing a lesser portion of the regenerated particulate sorbent to pass through a second, smaller contactor;

(e) contacting said regenerated particulate sorbent portion in said second contactor with said contaminated used lube oil for a period of time in a range of about 1 to 3 seconds at a temperature of about 350° C. to about 500° C. and converting said used lube oil to substantially decontaminated hydrocarbon product; and (f) separating contaminated sorbent formed from contact with said used lube oil from the product formed in said second contactor; and (g) returning said contaminated sorbent formed from contact with said used lube oil to said regenerator for regeneration and recycle to said first contactor.

2. A process according to claim 1 wherein said contaminated used lube oil comprises used lubricating oil.

3. A process according to claim 1 wherein about 3 to 12 kilograms of said particulate sorbent contact each kilogram of said used lube oil.

* * * * *